US010645758B2

(12) United States Patent
Schaumann et al.

(10) Patent No.: US 10,645,758 B2
(45) Date of Patent: May 5, 2020

(54) HEATING DEVICE

(71) Applicant: E.G.O. Elektro-Geraetebau GmbH, Oberderdingen (DE)

(72) Inventors: Uwe Schaumann, Oberderdingen (DE); Christian Seidler, Bretten (DE); Michael Riffel, Oberderdingen (DE); Wolfgang Wittenhagen, Oberderdingen (DE); Lutz Ose, Sternenfels (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 735 days.

(21) Appl. No.: 15/358,685

(22) Filed: Nov. 22, 2016

(65) Prior Publication Data

US 2017/0156178 A1 Jun. 1, 2017

(30) Foreign Application Priority Data

Nov. 26, 2015 (DE) ..... 10 2015 223 493

(51) Int. Cl.
*H05B 3/28* (2006.01)
*H05B 3/26* (2006.01)
(Continued)

(52) U.S. Cl.
CPC ..... *H05B 3/26* (2013.01); *H05B 3/283* (2013.01); *H05B 3/10* (2013.01); *H05B 3/16* (2013.01);
(Continued)

(58) Field of Classification Search
None
See application file for complete search history.

(56) References Cited

U.S. PATENT DOCUMENTS 3,413,439 A * 11/1968 Eisler ..... F24D 13/02 219/213
3,792,232 A * 2/1974 Zarenko ..... B32B 17/10036 219/522
(Continued)

FOREIGN PATENT DOCUMENTS

DE 1690298 A1 5/1971
DE 2148243 A1 4/1973
(Continued)

OTHER PUBLICATIONS

European Patent Office, Extended European Search Report for Application No. 16199804.2, dated Apr. 20, 2017, 8 pages, Germany.
(Continued)

*Primary Examiner* — Joseph M Pelham
(74) *Attorney, Agent, or Firm* — Alston & Bird LLP

(57) ABSTRACT

A heating device has a support and a heating element arranged on it, the heating element having two electrical terminals and a multiplicity of heating conductors that are electrically connected to one another. Starting from the one terminal, the heating element is divided into a number of heating conductors parallel to one another and in series one behind the other toward the second terminal. In this case, at least three heating conductors are connected in parallel next to one another and at least three heating conductors are connected in series one behind the other. Series-connected heating conductor groups can be formed, heating conductors being parallel within a heating conductor group.

36 Claims, 3 Drawing Sheets

(51) Int. Cl.
*H05B 3/16* (2006.01)
*H05B 3/10* (2006.01)

(52) U.S. Cl.
CPC .. *H05B 2203/002* (2013.01); *H05B 2203/013* (2013.01); *H05B 2203/037* (2013.01)

(56) References Cited

U.S. PATENT DOCUMENTS

| | | | | |
|---|---|---|---|---|
| 5,268,558 | A * | 12/1993 | Youssef | H05B 3/26 219/209 |
| 6,137,089 | A * | 10/2000 | Pragt | A47J 27/21041 219/436 |
| 6,169,275 | B1 | 1/2001 | Noda et al. | |
| 6,175,098 | B1 | 1/2001 | Kim et al. | |
| 8,653,422 | B2 | 2/2014 | Shimura et al. | |
| 2003/0196999 | A1 | 10/2003 | Kato et al. | |
| 2008/0083743 | A1* | 4/2008 | Wheeler | B32B 7/02 219/538 |
| 2014/0003848 | A1* | 1/2014 | Sakakibara | H05B 3/0095 399/335 |
| 2014/0193182 | A1* | 7/2014 | Shimura | H05B 3/0095 399/329 |

FOREIGN PATENT DOCUMENTS

| | | | |
|---|---|---|---|
| DE | 3545454 | A1 | 7/1987 |
| DE | 19713482 | A1 | 9/1998 |
| DE | 19741093 | A1 | 3/1999 |
| DE | 10108662 | A1 | 8/2001 |
| DE | 10021512 | A1 | 11/2001 |
| DE | 19952279 | B4 | 6/2006 |
| DE | 102005057566 | A1 | 6/2007 |
| EP | 1152639 | A2 | 11/2001 |
| EP | 2476027 | B1 | 6/2014 |
| FR | 1322991 | A | 4/1963 |
| GB | 1202522 | A | 8/1970 |

OTHER PUBLICATIONS

German Patent and Trademark Office, German Office Action for German Patent Application No. 102015223493.2, dated Oct. 4, 2019, (6 pages), Munchen, Germany.

* cited by examiner

HEATING DEVICE

CROSS-REFERENCE TO RELATED APPLICATIONS

This application claims priority to German Application No. 10 2015 223 493.2, filed Nov. 26, 2015, the contents of which are hereby incorporated herein in its entirety by reference.

TECHNOLOGICAL FIELD

The invention relates to a heating device comprising a support and a heating element arranged on it.

BACKGROUND

In the prior art there are numerous heating devices comprising a support and a heating element arranged on it, for example corresponding to DE 19741093 A1 or DE 3545454 A1. There it is attempted by the structural configuration of the heating element to heat the surface area of the support over as large an area as possible and as uniformly as possible, in order to produce a development of heat that is as good as possible on a heating side of the support.

Furthermore, it is known for example from EP 1152639 A2 to arrange a heating element on a support in a so-called meandering form. The looping of the meandering form is intended to cover substantially the entire surface area of the support, and consequently likewise make uniform heating possible.

BRIEF SUMMARY

The invention addresses the problem of providing a heating device mentioned at the beginning with which problems of the prior art can be solved and with which it is possible in particular to produce a uniformly distributed heating output and to make uniform heating possible.

This problem is solved by a heating device. Advantageous and preferred configurations of the invention are the subject of the further claims and are explained in more detail below. The wording of the claims is made the content of the description by express reference.

It is provided that the heating device has a support and at least one heating element arranged on it, advantageously an ohmic heating element or a resistance heating element. The heating element is advantageously only arranged on one side or surface of the support, in particular on a heating element side, and the other side of the support has no heating element. It can thus be a heating side. The heating element has two electrical terminals, advantageously as terminal zones. The heating element also has a multiplicity of heating conductors that are electrically connected to one another or is divided into such conductors, which together form the heating element. In this case, a number of heating conductors are connected in parallel next to one another and a number of heating conductors are connected in series one behind the other.

According to the invention, starting from the one terminal, the heating element is divided into a number of heating conductor groups in series one behind the other, that is to say also a number of heating conductors one behind the other. In this case, at least three heating conductors are provided in a heating conductor group, connected in parallel to one another, or it branches into corresponding heating conductors, and at least three heating conductor groups are provided, connected in series to one another towards the other terminal. Between the terminals, the heating element is therefore divided into parallel-connected heating conductors and series-connected heating conductors, respectively in heating conductor groups, in particular in series-connected heating conductor groups. This makes it possible to achieve a large number of heating conductors, which in particular as a result of the parallel connection can cover a great width of the support. It is therefore possible to avoid forming long heating conductors in a meandering form, with the resultant disadvantages for current flow.

Advantageously, the electrical current density at each point of the heating element differs by a maximum of 10% to 25%, that is to say considered at each heating conductor and at each point of each heating conductor. Particularly advantageously, the electrical current density at each point of the heating element is even substantially or completely the same. Thus, uniform production of heating output, that is to say heat, is achieved. Furthermore, regions of overloading or excessive temperature can be avoided.

In one configuration of the invention, the overall perpendicular sectional area of all of the heating conductors in each heating conductor group differs from heating conductor group to heating conductor group only by a maximum of 5% to 15%. Preferably, it is substantially or completely the same.

In one configuration of the invention, the heating conductors may cover or enclose the main surface area of the support, in particular at least 80% to 90%. This does not mean that in fact this surface area of the support is directly covered by heating conductors. However, heating conductors are provided over the main surface area of the support in a distributed manner, their distance from one another or from the adjacent heating conductor being such that a virtually uniformly distributed heating output is produced on the surface area. Free regions of the support without heating conductors may in this case be provided between the heating conductors, adjacent free regions preferably being separated from one another by heating conductors. The width and/or length of the free regions or their size may be of a similar magnitude to those of the heating conductors. While their width however advantageously and almost necessarily varies, the width respectively of a heating conductor should remain the same for a uniformly produced heating output along its length.

The direct area coverage of the support by heating conductors may be approximately of the same magnitude as by free regions, under some circumstances between 30% and 70%.

Near an outer edge of the support, an edge region, in particular with a width of at least 1 cm and/or at least 5% of a maximum width of the support, may be free from heating conductors. The width is preferably a maximum of 2 cm to 3 cm. Then a fastening or securing of the support can for example take place at this edge region. It can similarly be avoided that heat dissipation is less in the edge region, and that overheating consequently occurs.

The heating element is advantageously divided into a number of different heating conductor groups of different widths of the heating conductors, preferably three to six heating conductor groups. Thus, within a heating conductor group all of the heating conductors may have the same width. Such a heating conductor group or width group of heating conductors may have a width that is an integral multiple of that of the next-narrower heating conductor group, for example two or three times the width. Such a graduation may apply to some or all of the heating conductor groups.

Preferably, the heating element is divided into a number of heating conductor groups one behind the other with different cross-sectional areas of the respective heating conductors, so that within a heating conductor group all of the heating conductors have the same cross-sectional area, preferably three heating conductor groups to six heating conductor groups. Particularly preferably, the heating conductors of a heating conductor group may have a cross section that is an integral multiple of that of the next-narrower heating conductor group, preferably two or three times the cross section. Correspondingly, the next-narrower heating conductor group can then have two or three times the number of narrower heating conductors. It goes without saying that it does not have to be an integral number.

Advantageously, starting from one terminal, the heating element at first branches step by step increasingly into more heating conductors. Then, the heating conductors are made to merge again step by step towards the second terminal. It is however also possible that there become fewer heating conductors, then more again, then fewer again.

The arrangement of the heating conductors from the first terminal to the branching into that heating conductor group with the most heating conductors may be mirror-symmetrical or point-symmetrical to the arrangement of the heating conductors towards the second terminal.

In one configuration of the invention, heating conductors, advantageously two to four heating conductors, are always connected to one another in a branching region. In this case, at least one heating conductor runs into the branching region and at least two heating conductors, preferably a maximum of four heating conductors, run out of this branching region with a smaller width and/or smaller cross-sectional area. In other words, the heating conductor is divided into at least two heating conductors. In this case, the width and/or the cross-sectional area of the heating conductor running into the branching region may correspond to the summated width and/or summated cross-sectional area of the heating conductors running out of this branching region. Thus, altogether the width or cross-sectional area through which current flows therefore always remains the same, it is just divided region by region among differing numbers of heating conductors.

In an aforementioned branching region, a sheet-like conducting material may be applied under the running-in and running-out heating conductors or on the running-in or running-out heating conductors, particularly advantageously under them. As a result, the branching itself may lie in the region of the conducting material and, outside the conducting material, the individual heating conductors, each considered on their own, may have a constant width and/or cross-sectional area or their width does not undergo any change. The conducting material has a considerably greater electrical conductivity than the heating conductors, for example it is the same material as for the terminals or terminal areas of the heating device. This achieves the effect that the current flow in the branching region takes place substantially only in the conducting material. Thus, a current flow that is homogeneous and uniform over the width and/or cross-sectional area can be achieved in the heating conductors, which is good for producing a uniform heating output, and in particular also spares the heating conductors. No pinch effects or the like can then occur at these conductors as a result of a shortened or intensified current flow. These branching regions may have the form of polygons, advantageously quadrangles or rectangles, or be provided with twice as many corners as heating conductors come together.

The heating conductors of a heating conductor group, in particular a number of heating conductor groups, may be parallel to one another within the heating conductor group, that is to say not only electrically connected in parallel but also geometrically parallel to one another. This may also apply to all of the heating conductor groups. Preferably, all of the heating conductors of all of the heating conductor groups may run parallel to one another. The advantage of parallel heating conductor groups is that then the free regions lying in between have the same width or the same cross-sectional area. Then, the production of heating output is to some extent equally distributed.

The thickness or layer thickness of all of the heating conductors is advantageously the same, it being particularly advantageous if their length can vary. Preferably, the heating conductors have a flat rectangular cross section. This is advantageous in particular whenever the heating element is applied to a support by the thick-film technique.

The width of the heating conductors may be very much greater than their thickness, in particular 20 times to 30 times. In this case, the heating conductors may be divided into a number of different heating conductor groups of the same widths and/or cross-sectional areas respectively within the heating conductor group; there are preferably three to six heating conductor groups. In this case, one heating conductor group may have a width and/or cross-sectional area that is an integral multiple of that of the heating conductor group with the next-narrower widths and/or cross-sectional areas, preferably two or three times the width and/or cross-sectional area.

The support may consist in particular of metal or ceramic. It may have a geometrical basic form, preferably round or rectangular.

The support may be flat or planar. In particular with an aforementioned simple embodiment of a geometrical basic form, a support may thus be formed for example for a heating device as the base of a water boiler.

In an alternative configuration of the invention, the support may be curved, preferably convex. In this case, the heating element may be arranged on its outer side. Such a support may be formed for example as a channel wall or housing wall, which is to be heated. As a result of the branchings into a multiplicity of heating conductors, with the good or uniform distribution in terms of surface area, even a complex and complicated surface can be heated with an approximately uniform output per unit area.

At least one of the terminals is advantageously arranged near an outer edge of the support, particularly preferably both terminals. Thus, they can be reached more easily for good electrical contacting. Alternatively, one of the two terminals may also be arranged in a middle region of the support, so that the heating conductors run towards it. In this case, both terminals may be arranged near an outer edge of the support, in particular the two terminals next to one another.

These and other features emerge not only from the claims but also from the description and the drawings, where the individual features can be realized in each case by themselves or as a plurality in the form of subcombinations in an embodiment of the invention and in other fields and can constitute advantageous and inherently protectable embodiments for which protection is claimed here. The subdivision of the application into individual sections and subheadings does not restrict the general validity of the statements made thereunder.

BRIEF DESCRIPTION OF THE SEVERAL VIEWS OF THE DRAWINGS

Exemplary embodiments of the invention are illustrated schematically in the drawings and are explained in greater detail below. In the drawings.

DETAILED DESCRIPTION

Figure 1:
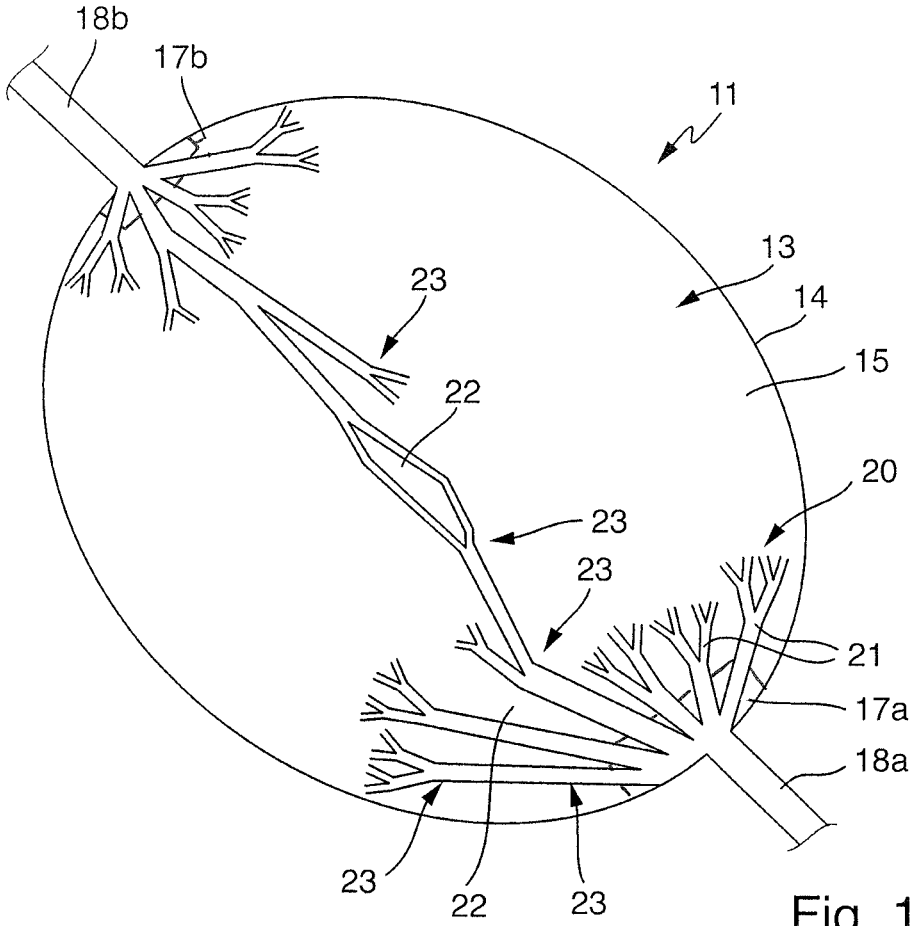
FIG. 1 shows a plan view of a schematically represented heating device according to the invention with a round support and a multiply branched heating element.

In FIG. 1, a heating device 11 in a first configuration is shown in a simplified form in plan view. The heating device 11 has an elongatedly oval support 13, for example of ceramic or insulating material, and is in particular flat or planar. The support 13 has a support edge 14 and a peripheral edge region 15, which is largely free.

Provided on the support, on top and underneath, are terminals 17*a* and 17*b*, from which there extends in each case a supply lead 18*a* and 18*b*. This may be a cable or some other conductor.

Between the terminals 17*a* and 17*b*, a heating element 20 runs on the support 13 as a resistance heating element, advantageously applied by the thick-film technique or as a thick-film heating element. This is known to a person skilled in the art and need not be explained in any more detail here.

The heating element 20 is multiply branched into a multiplicity of heating conductors 21, which are then connected in parallel with one another and in series one behind the other. With each branching in a branching region, the heating conductors 21 become thinner, in particular the width of a heating conductor at the branching dividing as it were into the outgoing narrower heating conductors. Consequently, the summated width of the heating conductors in one heating conductor group, in which all of the heating conductors have the same width, may as it were be the same as that of the heating conductors of another heating conductor group. From the terminals 17*a* and 17*b* there respectively extend four heating conductors 21, or here the heating element 20 in each case branches into four. These four heating conductors 21 are then in turn respectively branched twice, with then subsequent renewed double branching. Altogether, there are then sixteen heating conductors in parallel in the heating conductor group with the smallest width of the heating conductors. Towards the other heating conductor 17*b*, the heating conductors 21 merge again, so that altogether a symmetrical structure is obtained in relation to an axis of symmetry exactly between the terminals 17*a* and 17*b*.

It can be well imagined on the basis of FIG. 1 that, with heating conductors 21, the main surface area of the support 13 is covered for uniform heating, without every part of the area of the support 13 being covered. Between the heating conductors 21 there are in each case free regions 22, which are elongated and, depending on the number of branchings delimiting them, multiply form irregular quadrangles. The branching regions 23 are in each case differently formed; in particular, they in fact comprise double, triple or even quadruple branches.

Figure 2:
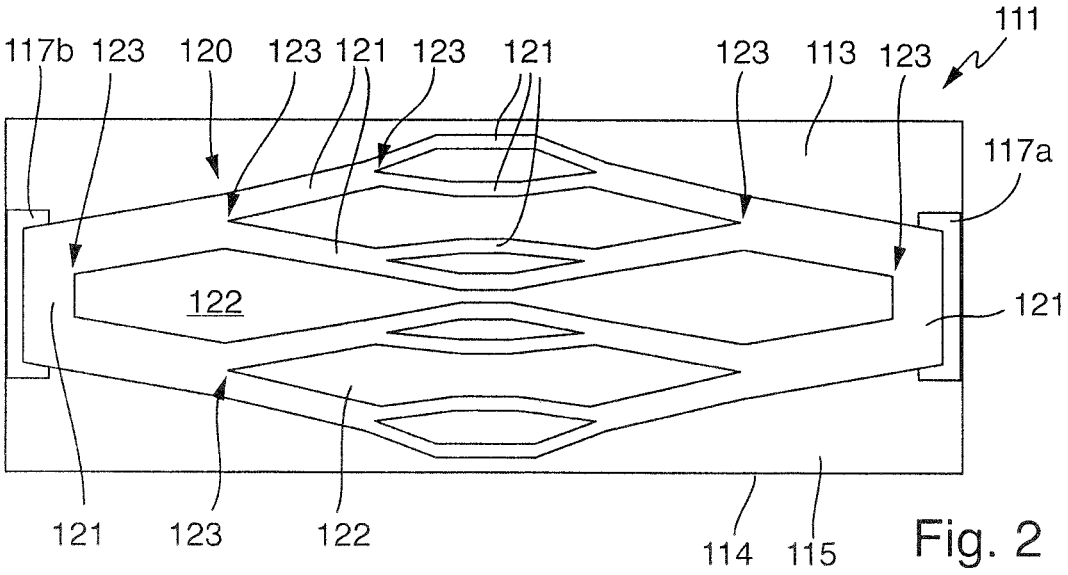
FIG. 2 shows an alternative heating device with an elongated rectangular support and a multiply branched heating element.

In FIG. 2, an alternative heating device 111 is represented, comprising a support 113, which in particular is formed as elongated, in particular elongatedly rectangular. Two terminals 117*a* and 117*b* are provided at the most remote end regions of the support 113. From the terminals 117*a* and 117*b* there respectively extends a heating element 120 of a single width, and then in three successive branching regions 123 it in each case branches twice. In a middle region of the heating device 111, eight parallel and relatively narrow heating conductors 121 are then provided. They form a heating conductor group. The next and next-wider heating conductor group has respectively to the left and right thereof four parallel heating conductors; the next-wider heating conductor group in turn has respectively to the left and right thereof two parallel-connected heating conductors.

It can be seen particularly well from FIG. 2 that here, depending on which portion is considered, altogether a number of heating conductors are connected in series and in each case also a number of heating conductors are connected in parallel. It is akin to a series connection of seven heating conductors each time and a parallel connection of a maximum of eight heating conductors, that is in the middle region. Here, too, it can be seen that, on the way from the left terminal 117*b* to the right terminal 117*a*, the summated width of the heating conductors remains substantially constant.

Figure 3:
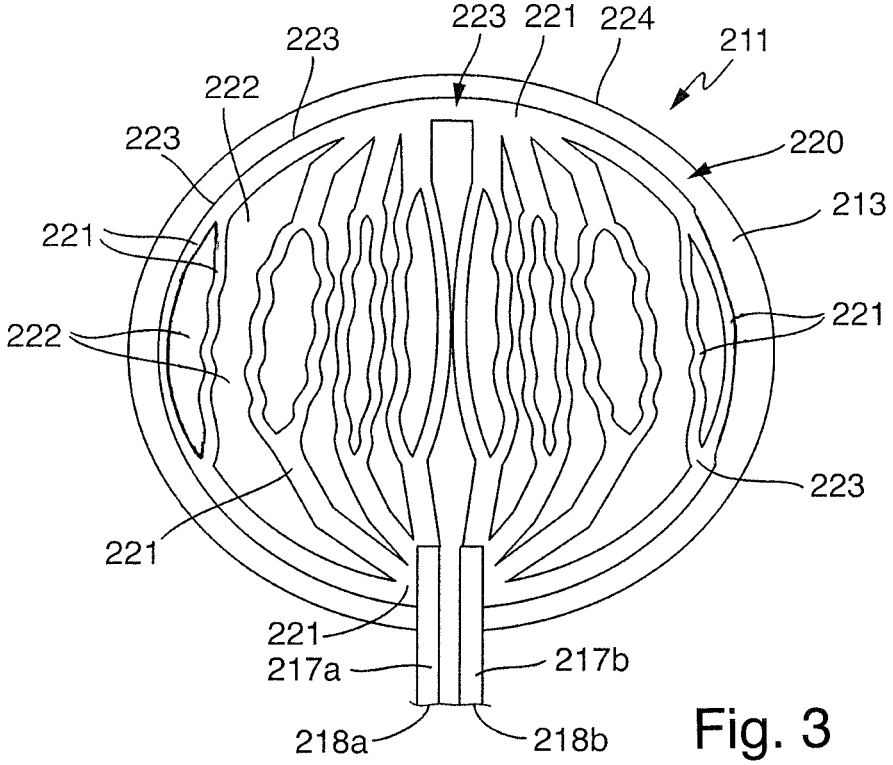
FIG. 3 shows a modification of a heating device similar to FIG. 1 with a round support, on which a symmetrical heating conductor structure is applied, with terminals lying directly next to one another.

In FIG. 3, a further alternative heating device 211 is represented, comprising in turn an approximately round support 213. Two terminals 217*a* and 217*b* are provided here as zones and are very close to one another in the edge region 215. From the terminals 217*a* and 217*b*, first there extend in each case two heating conductors, which then very quickly branch in each case into two further heating conductors. These then branch once again into two heating conductors, so that here, too, in the narrowest heating conductor group there are sixteen heating conductors. As a result of the merging of all of the heating conductors at the end of the support 213 remote from the terminals 217*a* and 217*b*, here there is as it were a series connection of two split regions similar to FIG. 2, just on a differently formed support 213. In the case of this configuration of FIG. 3, it can also be easily imagined how the two terminals 217*a* and 217*b* could be electrically connected together and, at the uppermost branching region 223, altogether a further electrical connection could then take place in a way similar to in the case of FIG. 1.

FIG. 3 also shows generally how over the path of the heating element 220 between the terminals 217*a* and 217*b*, after a splitting or branching there may be a merging and then again however a branching. In the case of complex formed paths, this may also be multiply repeated.

Figure 4:
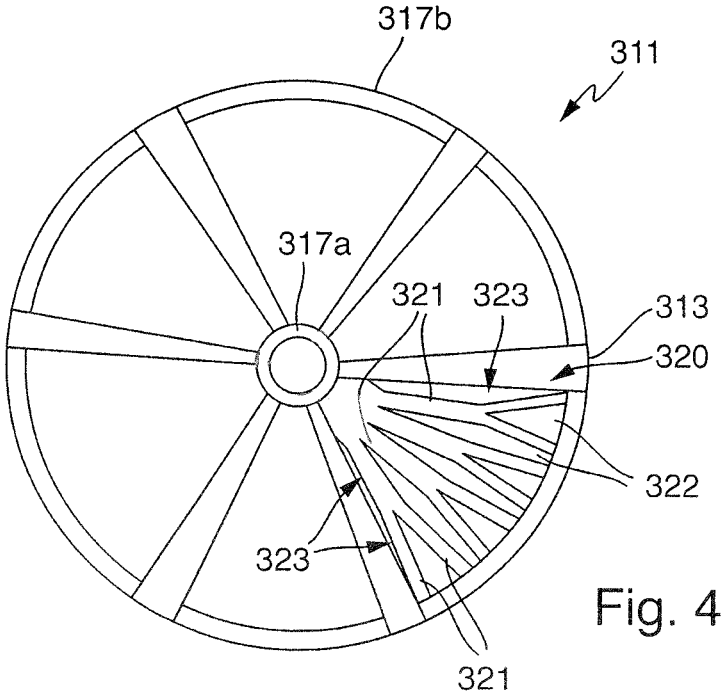
FIG. 4 shows a further alternative configuration of a heating device with a central terminal in a middle region and an annular terminal running around the outside.

In the case of the again further alternative configuration of a heating device 311 corresponding to FIG. 4, a number of heating conductors extend from a central terminal 317*a* outwards in a radial direction onto a circular support 313, to be precise in each case in one of six segments of a circle. They then each branch twice into two. The width of the segments of a circle that are covered by these heating conductors, or the angle covered by them, may vary. Here, there are for example six segments of a circle, so that 48 narrow heating conductors arrive at the terminal 317*b*.

Figure 5:
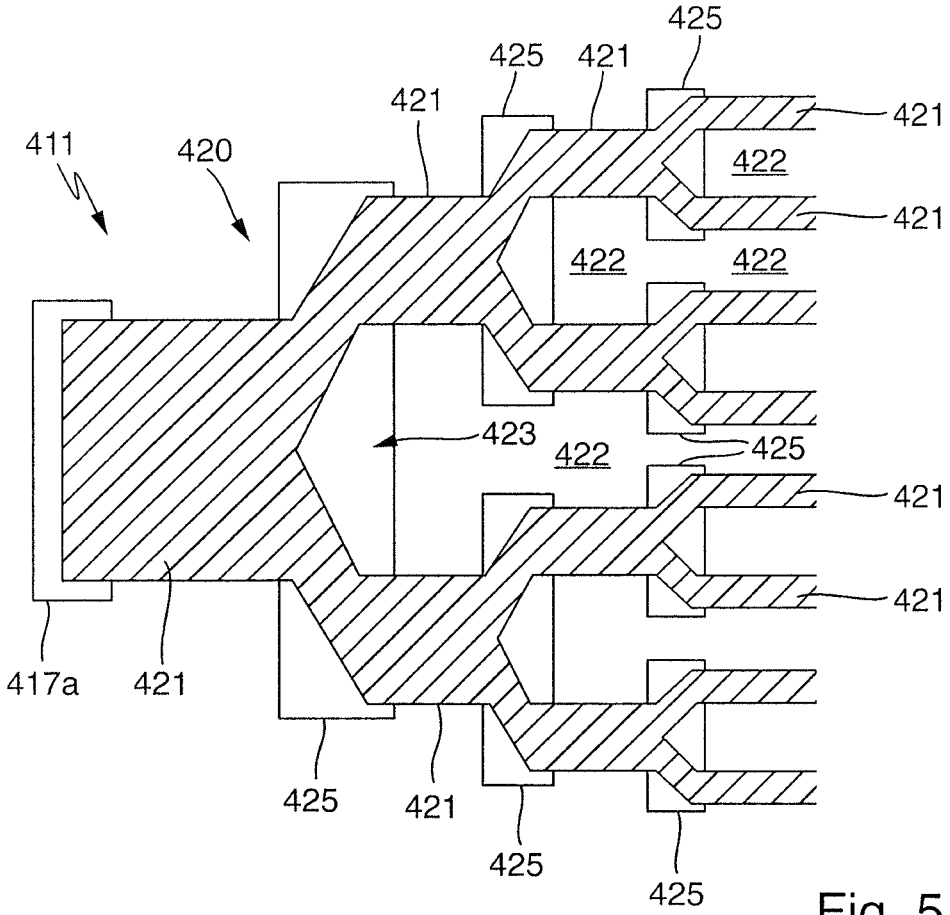
FIG. 5 shows a schematically simplified representation, illustrating how in a way similar to FIG. 1 the heating conductors of a heating element geometrically split into various heating conductor groups.

In FIG. 5 it is shown in a simplified and very schematic form how, coming from the left, at a heating element 420 a very wide heating conductor 421 goes into a first branching region 423. There, it branches into two narrower heating conductors, the summated width of which however corresponds exactly to the width of the wide heating conductor 421. In order however not to have any abruptly changing current densities, pinch effects or shortening effects in the branching region, conducting material 425 with good electrical conduction is in fact provided here in the manner of a zone, preferably rectangular. Advantageously, this conducting material 425 is applied directly to a support 413 lying under it, alternatively to its electrically insulated surface. The electrical conductivity of the conducting material 425 is a number of times greater than that of the material of the heating element 420, for example five to ten times as great. It is thus possible that the very wide heating conductor 421 comes from the left and runs into the first branching region 423. From the branching region 423, and consequently away from the conducting material 425, there extend two narrower heating conductors 421, which on account of the same summated width produce the same heating output, but as it were distributed over a greater surface area, because, that is, they also heat a region respectively to the left and right of the heating conductors. It can also be seen that, as a result of the conducting material 425 used, the path of the heating conductors in the branching region 423 in itself is irrelevant, only the branching or splitting is of importance. The heating conductors 421 should in each case extend away from the conducting material 425 in a straight line, that is to say as it were substantially at right angles to its edge. It can also be seen from FIG. 5 that the zones with conducting material 425 become increasingly smaller, but, for that, a number are as it were in parallel next to one another.

Figure 6:
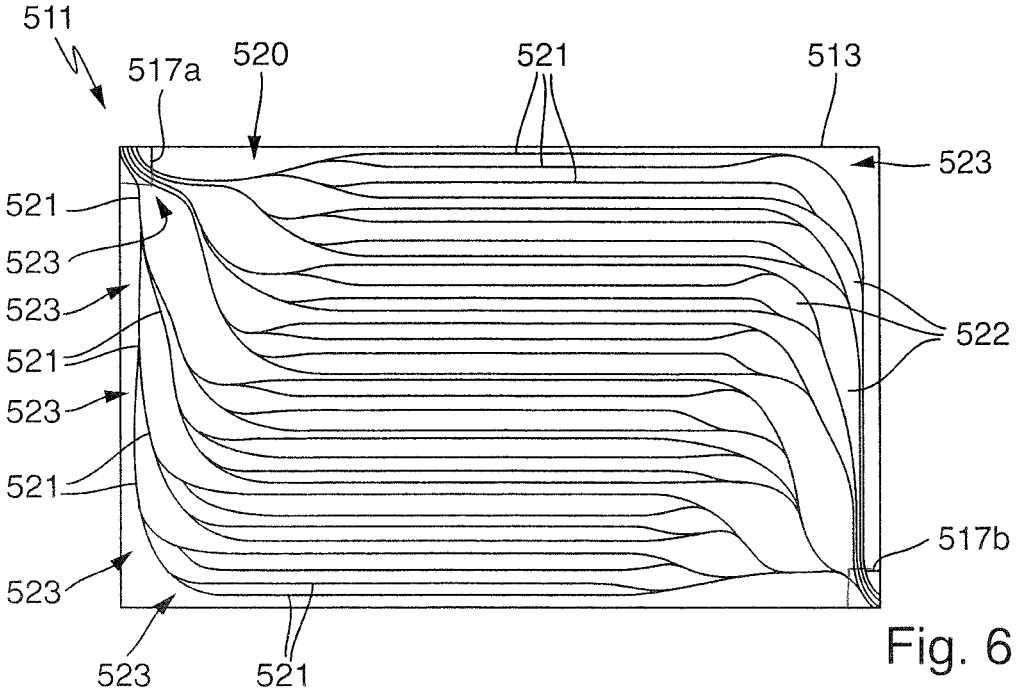
FIG. 6 shows a further alternative configuration of a heating device.

In yet a further alternative configuration of a heating device 511 according to FIG. 6, the support 513 is rectangular. Terminals 517*a* and 517*b* lie in opposite corners. Shown here is a form of a heating element 520 in which the heating element is divided into heating conductors 521 in such a way that in each case a heating conductor 521 branches into two further heating conductors or two heating conductors 521 are then made to merge into one heating conductor. Thus, along a strand there are five branchings 523 with dividing and five branchings 523 with merging of the heating conductors 521. For reasons of overall clarity, in FIG. 6 all of the heating conductors are shown with approximately the same widths. However, this should not be so in reality; instead, the width of a heating conductor 521 should half each time it branches into two heating conductors 521. In view of the density of the coverage with heating conductors in the case of the heating device 511 according to FIG. 6, this cannot however be shown. Alternatively, with the width remaining the same, the thickness could half, then FIG. 6 would be exactly correct.

It can be seen well from FIG. 6 that there is not in fact very dense coverage of the surface area of the support 513 in the edge regions, in particular in the vicinity of the terminals 517. Here, the free regions 522 are also relatively wide near the corner regions with the terminals 517, but then become very narrow, in particular in the middle region with the narrowest heating conductors 521. Here there is a very dense coverage with narrow heating conductors 521 and with narrow free regions 522.

Here, all of the supports are formed as flat or planar. It can however easily be imagined that a support also has a curved surface, advantageously convexly curved. The surface may however also be complexly formed and provided with heating conductors. Branchings and mergings also allow a complex three-dimensional surface to be covered.

FIGS. 2 and 3 show mirror-symmetrical configurations of the heating conductors. FIGS. 4 and 6 show point-symmetrical configurations of the heating conductors.

That which is claimed:

1. A heating device comprising:

a support and a heating element arranged on said support;

said heating element comprising a first electrical terminal and a second electrical terminal; and said heating element comprising a multiplicity of heating conductors that are electrically connected to one another, and wherein starting from said first terminal, said heating element is divided into a number of heating conductor groups in series one behind the other, wherein at least three said heating conductor groups are connected in series to one another between said first terminal and said second terminal, wherein in at least one said heating conductor group, at least three said heating conductors are provided, connected in parallel to one another, and wherein said heating element is divided into a number of said heating conductor groups with different cross-sectional areas of said respective heating conductors, so that within one said heating conductor group all of said heating conductors have the same cross-sectional area.

2. The heating device according to claim 1, wherein an electrical current density at each point of said heating element differs by a maximum of 25%.

3. The heating device according to claim 2, wherein said electrical current density at each point of said heating element is the same.

4. The heating device according to claim 1, wherein said support has a surface area and said heating conductors cover or enclose between 80% and 90% of said surface area of said support, free regions of said support without heating conductors being provided between said heating conductors.

5. The heating device according to claim 4, wherein adjacent of said free regions are separated from one another by heating conductors.

6. The heating device according to claim 1, wherein near an outer edge of said support, an edge region is free from heating conductors.

7. The heating device according to claim 6, wherein near said outer edge of said support, an edge region with a width between 1 cm and a maximum of 3 cm is free from heating conductors.

8. The heating device according to claim 6, wherein near said outer edge of said support, an edge region with a width of at least 5% of a maximum width of said support is free from heating conductors.

9. The heating device according to claim 1, wherein said heating element is divided into a number of said heating conductor groups of different widths of said heating conductors, so that within one said heating conductor group all of said heating conductors have the same width.

10. The heating device according to claim 9, wherein said heating element is divided into three said heating conductor groups to six said heating conductor groups of different widths of said heating conductors, so that within one said heating conductor group all of said heating conductors have the same width.

11. The heating device according to claim 9, wherein said heating conductors of said heating conductor group have a width that is an integral multiple of a width of a next-narrower heating conductor group.

12. The heating device according to claim 11, wherein said heating conductors of said heating conductor group have a width that is two or three times a width of said next-narrower heating conductor group.

13. The heating device according to claim 1, wherein said heating element is divided into three said heating conductor groups to six said heating conductor groups with different cross-sectional areas of said respective heating conductors, so that within one said heating conductor group all of said heating conductors have the same cross-sectional area.

14. The heating device according to claim 1, wherein said heating conductors of said heating conductor group have a cross-sectional area that is an integral multiple of a cross-sectional area of a next-narrower heating conductor group.

15. The heating device according to claim 14, wherein said heating conductors of said heating conductor group have a cross-sectional area that is two or three times the cross-sectional area of said next-narrower heating conductor group.

16. The heating device according to claim 1, wherein an arrangement of said heating conductors from said first terminal to said branching into a heating conductor group with the most heating conductors is mirror-symmetrical to an arrangement of said heating conductors towards said second terminal.

17. The heating device according to claim 1, wherein an arrangement of said heating conductors from said first terminal to said branching into a heating conductor group with the most heating conductors is point-symmetrical to an arrangement of said heating conductors towards said second terminal.

18. The heating device according to claim 1, wherein heating conductors of a number of said heating conductor groups run parallel to one another within said heating conductor group.

19. The heating device according to claim 18, wherein all of said heating conductors of all of said heating conductor groups run parallel to one another.

20. The heating device according to claim 1, wherein a thickness of all said heating conductors is the same and said heating conductors have a flat rectangular cross-section.

21. The heating device according to claim 1, wherein a width of said heating conductors is 10 times to 30 times greater than their thickness, said heating conductors being divided into a number of different ones of said heating conductor groups of the same widths or cross-sectional areas respectively within said heating conductor group.

22. The heating device according to claim 21, wherein one said heating conductor group has a width or cross-sectional area that is an integral multiple of that of a heating conductor group with a next-narrower width or cross-sectional area.

23. The heating device according to claim 22, wherein said heating conductor group has a width or cross-sectional area that is two or three times said width or said cross-sectional area of said heating conductor group with said next-narrower width or said next-narrower cross-sectional area.

24. The heating device according to claim 1, wherein said heating element is applied to a support of metal or ceramic by a thick-film technique.

25. The heating device according to claim 1, wherein said support has a geometrical basic form being round or rectangular.

26. The heating device according to claim 1, wherein said support is flat or planar.

27. The heating device according to claim 1, wherein said support is curved or convex with said heating element being arranged on its outer side.

28. The heating device according to claim 1, wherein at least one said terminal is arranged near an outer edge of said support.

29. The heating device according to claim 28, wherein both said terminals are arranged next to one another and near said outer edge of said support.

30. A heating device comprising:

a support and a heating element arranged on said support;

said heating element comprising a first electrical terminal and a second electrical terminal; and said heating element comprising a multiplicity of heating conductors that are electrically connected to one another, and wherein:

starting from said first terminal, said heating element is divided into a number of heating conductor groups in series one behind the other, at least three said heating conductor groups are connected in series to one another between said first terminal and said second terminal, in at least one said heating conductor group, at least three said heating conductors are provided, connected in parallel to one another, and starting from said first terminal, said heating element at first branches step by step increasingly into more of said heating conductors, said heating conductors then are made to merge again step by step towards said second terminal.

31. The heating device according to claim 30, wherein said support has a geometrical basic form being round or rectangular.

32. The heating device according to claim 30, wherein heating conductors of a number of said heating conductor groups run parallel to one another within said heating conductor group.

33. A heating device comprising:

a support and a heating element arranged on said support;

said heating element comprising a first electrical terminal and a second electrical terminal; and said heating element comprising a multiplicity of heating conductors that are electrically connected to one another, and wherein:

starting from said first terminal, said heating element is divided into a number of heating conductor groups in series one behind the other, at least three said heating conductor groups are connected in series to one another between said first terminal and said second terminal, in at least one said heating conductor group, at least three said heating conductors are provided, connected in parallel to one another, and two or three said heating conductors are always connected to one another in a branching region, at least one said heating conductor running into said branching region and at least two said heating conductors running out of said branching region with a smaller width or smaller cross-sectional area.

34. The heating device according to claim 33, wherein said width of said heating conductor running into said branching region is the same as a summated width of said heating conductors running out of said branching region.

35. The heating device according to claim 33, wherein said cross-sectional area of said heating conductor running into said branching region corresponds to a summated cross-sectional area of said heating conductors running out of said branching region.

36. The heating device according to claim 33, wherein, in said branching region, a sheet-like electrically conducting material is applied under said running-in and said running-out heating conductors or on said running-in or said running-out heating conductors in such a way that said branching itself lies in said region of said conducting material and, outside said conducting material, said heating conductors, each considered on their own, have a constant width or cross-sectional area or have no change in their width or cross-sectional area.

* * * * *